US007704104B2

(12) United States Patent
Duley

(10) Patent No.: US 7,704,104 B2
(45) Date of Patent: Apr. 27, 2010

(54) BUS BAR SYSTEM, METHOD, AND KIT

(76) Inventor: Wayne C. Duley, 4711 Tabscott Rd., Kents Store, VA (US) 23084

( * ) Notice: Subject to any disclaimer, the term of this patent is extended or adjusted under 35 U.S.C. 154(b) by 0 days.

(21) Appl. No.: 12/215,365

(22) Filed: Jun. 26, 2008

(65) Prior Publication Data

US 2009/0004895 A1 Jan. 1, 2009

Related U.S. Application Data

(60) Provisional application No. 60/937,352, filed on Jun. 27, 2007.

(51) Int. Cl.
*H01R 11/01* (2006.01)

(52) U.S. Cl. ..... 439/756

(58) Field of Classification Search ..... 439/756, 439/754, 766, 522, 502; 174/3, 6, 5 R
See application file for complete search history.

(56) References Cited

U.S. PATENT DOCUMENTS

| | | | | |
|---|---|---|---|---|
| 196,518 | A | 10/1877 | Brown | |
| 362,062 | A | 5/1887 | Cole | |
| 1,013,305 | A | 1/1912 | Pardee | |
| 1,243,774 | A | 10/1917 | Soengen | |
| 2,739,998 | A | 3/1956 | Kretzer | |
| 4,118,097 | A * | 10/1978 | Budnick | 439/387 |
| 4,932,896 | A * | 6/1990 | Julian | 439/504 |
| 5,620,338 | A * | 4/1997 | Stephens et al. | 439/522 |
| 6,498,291 | B2 | 12/2002 | Brammer | |
| 6,719,595 | B1 * | 4/2004 | Welcker | 439/883 |
| 7,173,181 | B2 | 2/2007 | Park | |

* cited by examiner

*Primary Examiner*—Chandrika Prasad
(74) *Attorney, Agent, or Firm*—Williams Mullen

(57) ABSTRACT

A replacement bus system having one or more conductive shafts supporting wire attachment lugs and spacers that ride along the conductive shaft; the spacers are conductive and separate the attachment lugs. The lugs and spacers may be secured onto the shaft by a locking mechanism. By providing a shaft on which the lugs may ride, the wires are configured transversely to conventional approaches, enabling a greater number of wires to be connected over a given length and a wider variety of relative orientation of wires. This configuration also enables much of the structure to be manufactured from stainless steel or other non cuprous metal, except for the spacers, which may be manufactured from tinned copper.

25 Claims, 16 Drawing Sheets

BUS BAR SYSTEM, METHOD, AND KIT

CROSS-REFERENCE TO PROVISIONAL APPLICATION

This application claims the benefit of U.S. Application Ser. No. 60/937,352, filed Jun. 27, 2007, entitled Bus Bar System and naming Wayne C. Duley as the inventor, the disclosure of which is hereby incorporated herein by reference in its entirety as if set forth fully herein.

FIELD OF INVENTION

This invention relates generally to a component for use in electrical systems, including grounding and energy dispersion systems directed to protect items from damaging current and voltage surges.

BACKGROUND OF THE INVENTION

Grounding and energy dispersion systems have been used historically to prevent current and voltage surges from damaging sites, structures, and electrical equipment. Conventional grounding systems may include elements such as ground rods, ground plates, ground electrodes, enhanced ground rods and chemical rods.

Grounding systems, like certain other electrical systems, often involve the collection of several wires that run from the grounded structure(s) to the dispersion system. Conventionally, such a collection has been achieved by the use of a bus bar. A conventional bus bar is a rectangular piece or bar of conductive material machined or adapted to receive fasteners connecting to the wires. The wires generally attach to the bus bar by some convenient and secure fastener, such as conventional nuts, washers, and bolts, which are received within a wire lug.

Because of its superior conductivity, conventional bus bars are most commonly constructed from copper. However, copper is a relatively expensive material, particularly for the robust systems capable of grounding lightning strikes. The value of copper has contributed to an increase in theft of grounding bus bars. In the grounding of often remote towers for cellular telephones, this problem is particularly acute.

SUMMARY OF THE INVENTION

The present invention relates to a component within an electrical system, including systems for harnessing and dispersing current or voltage surges. The present invention is a replacement bus system having one or more conductive shafts supporting attachment lugs and one or more spacers that ride along the conductive shaft; the spacers are conductive and separate the attachment lugs. The lugs and spacers may be secured onto the shaft by a locking mechanism. By providing a shaft on which the lugs may ride, the wires are configured transversely to conventional approaches, enabling a greater number of wires to be connected over a given length. This configuration also enables the structure to be manufactured from stainless steel, except for the spacers, which may be manufactured from tinned copper. Because the spacers represent less mass per attachment lug than is used in a conventional bus bar, the present invention produces a significant reduction in copper use. Moreover, experimental data show that the present invention performs equivalently to a copper bus bar.

One embodiment of the invention is a bus system for connecting a first wire lug to a second wire lug, the first wire lug having a first barrel end and an opposing first tang end defining a first stud hole and the second wire lug having a second barrel end and an opposing second tang end defining a second stud hole, with the bus system including (1) an elongated shaft having a cross section and a desired length, with the shape and size of the cross section of the shaft being smaller than the shape and size of the first and second stud holes, so that the shaft is capable of passing through the first stud hole and the second stud hole such that the first lug and the second lug may be mounted onto the shaft with the shaft substantially perpendicular to the first and second tang ends, (2) a conductive spacer having a desired thickness and defining a spacer hole, with the shape and size of the spacer hole being larger than the shape and size of the cross section of the shaft, so that the shaft is capable of passing through the spacer hole such that the spacer may be mounted onto the shaft with the shaft substantially perpendicular to the spacer and with the desired thickness of the spacer oriented along the length of the shaft, and (3) at least one locking mechanism having a locking surface, the locking mechanism adapted to engage the shaft at a desired location and to present the locking surface with an orientation substantially perpendicular to the shaft. In this embodiment, the first wire lug, the second wire lug, and the spacer are capable of being mounted onto the shaft with the spacer interposed between and separating the first and second tang ends of the first and second wire lugs in sandwich fashion, with the shaft substantially perpendicular to the first and second tang ends, and the at least one locking mechanism may be engaged with the shaft such that the locking surface secures the wire lugs and spacer at a desired location and in electrical contact. In another embodiment of the invention, the bus system described above also includes a mounting mechanism having a first end capable of being attached to the shaft and a second end capable of being affixed to a surface of a structure, the first end being adapted to position the shaft in a desired configuration away from the surface.

Another embodiment of the invention is a bus system having (1) a plurality of wire lugs, optionally formed from stainless steel, each of the wire lugs having a barrel end and an opposing tang end, each of the tang ends of the wire lugs defining a pair of stud holes and having a desired length and each of the barrel ends having a desired width, (2) two elongated shafts, optionally formed from stainless steel, each of the shafts having a cross section, optionally a circular cross section (in which case the shaft is optionally threaded), and a desired length, with each of the cross sections having a shape and size smaller than the shapes and sizes of the pair of stud holes, so that the shafts are capable of passing through the pair of stud holes within the tang ends of each of the wire lugs so that the wire lugs may be mounted onto the shafts with the shafts substantially perpendicular to the tang ends of the wire lugs, (3) one or more conductive spacers, optionally formed from tinned copper, each of the one or more spacers having a desired thickness and a desired length, optionally a length at least as great as the lengths of the tang ends of the wire lugs, and defining a pair of spacer holes, wherein the shapes and sizes of the spacer holes are larger than the shapes and sizes of the cross sections of the shafts, so that the shafts are capable of passing through the spacer holes such that the one or more spacers may be mounted onto the shafts with the shafts substantially perpendicular to the one or more spacers and the desired thickness of the one or more spacers oriented along the length of the shafts, and (4) at least one locking mechanism having a locking surface, the locking mechanism adapted to engage the shafts at a desired location and to present the locking surface with an orientation substantially perpendicular to the shafts, with the locking mechanism optionally being one or more nuts and one or more washers (one or more of which may be a Belleville washer), formed to fit the optional threaded circular shafts, with the locking surface being located on one or more of the washers. In this embodiment, the plurality of wire lugs and the one or more spacers are capable of being mounted onto the shafts in sandwich fashion, with the shafts substantially perpendicular to the tang ends of the wire lugs and substantially perpendicular to the one or more spacers and the at least one locking mechanism may be engaged with the shafts such that the locking surface secures the wire lugs and one or more spacers at a desired location and in electrical contact. This embodiment may also include a mounting mechanism having a first end capable of being attached to the shafts and a second end capable of being affixed to a surface of a structure, the first end being adapted to position the shafts in a desired configuration away from the surface. Or the embodiment may also include (1) a first mounting mechanism that is a substantially L-shaped bracket having a receiving end and a mounting end, (2) a second mounting mechanism that is a substantially U-shaped bracket having an attaching surface and one or more securing surfaces, and (3) a second locking mechanism having a second locking surface, in which (a) the receiving end of the substantially L-shaped bracket is capable of receiving the shafts and the mounting end of the substantially L-shaped bracket is capable of being attached to the attaching surface of the substantially U-shaped bracket, (b) the one or more securing surfaces of the substantially U-shaped bracket are capable of being affixed to a surface of a structure, (c) the substantially U-shaped bracket is adapted to position the substantially L-shaped bracket and the shafts in a desired configuration away from the surface, and (d) the second locking mechanism is capable of securing the second mounting mechanism to the first mounting mechanism such that the second locking surface contacts at least one of the mounting end of the substantially L-shaped bracket and the attaching surface of the substantially U-shaped bracket, with an optional insulator capable of being secured between the substantially L-shaped bracket and the substantially U-shaped bracket by the second locking mechanism. In an optional arrangement, the plurality of wire lugs includes a first set of one or more wire lugs and a second set of one or more wire lugs, optionally having fewer wire lugs than the first set, with the respective barrel ends of the first set of wire lugs and second set of wire lugs being at an angle of about 180 degrees, and with the one or more spacers optionally having a length at least as great as the lengths of the tang ends of the wire lugs and optionally having a thickness at least as great as the widths of the barrel ends of the wire lugs in the first set of lugs.

Another embodiment of the invention is a method of protecting electrical components attached to a structure from electrical-surge damage, which involves (1) providing one of the bus systems described above, (2) affixing the bus system to the structure, which is optionally a cellular telephone tower (or a structure attached to one) or other part of a communication system, (3) connecting one or more of the wire lugs of the bus system to a grounding kit, and (4) connecting the bus system to an earth grounding system. In one form of this embodiment, the four steps are performed in the order stated. In another form of this embodiment of the invention, the method includes affixing the bus system to the structure using a mounting mechanism that is part of the bus system and has a first end capable of being attached to the shafts of the bus system and a second end capable of being affixed to a surface of the structure, the first end being adapted to position the shafts in a desired configuration away from the surface.

Another embodiment of the invention is a bus system installation kit, which includes a container holding (1) a plurality of wire lugs, each of the wire lugs having a barrel end and an opposing tang end, each of the tang ends of the wire lugs defining a pair of stud holes and having a desired length and each of the barrel ends having a desired width, (2) two elongated shafts, each of the shafts having a cross section and a desired length, with each of the cross sections having a shape and size smaller than the shapes and sizes of the pair of stud holes, so that the shafts are capable of passing through the pair of stud holes within the tang ends of each of the wire lugs so that the wire lugs may be mounted onto the shafts with the shafts substantially perpendicular to the tang ends of the wire lugs, (3) one or more conductive spacers, each of the one or more spacers having a desired thickness and a desired length and defining a pair of spacer holes, with the shapes and sizes of the spacer holes being larger than the shapes and sizes of the cross sections of the shafts, so that the shafts are capable of passing through the spacer holes such that the one or more spacers may be mounted onto the shafts with the shafts substantially perpendicular to the one or more spacers and the desired thickness of the one or more spacers oriented along the length of the shafts, and (4) at least one locking mechanism having a locking surface, the locking mechanism adapted to engage the shafts at a desired location and to present the locking surface with an orientation substantially perpendicular to the shafts. In this embodiment, the plurality of wire lugs and the one or more spacers are capable of being mounted onto the shafts in sandwich fashion, with the shafts substantially perpendicular to the tang ends of the wire lugs and substantially perpendicular to the one or more spacers and the at least one locking mechanism may be engaged with the shafts such that the locking surface secures the wire lugs and one or more spacers at a desired location and in electrical contact. Other embodiments of the invention include similar bus system installation kits having other combinations of parts.

DETAILED DESCRIPTION OF THE PREFERRED EMBODIMENTS

Figure 1:
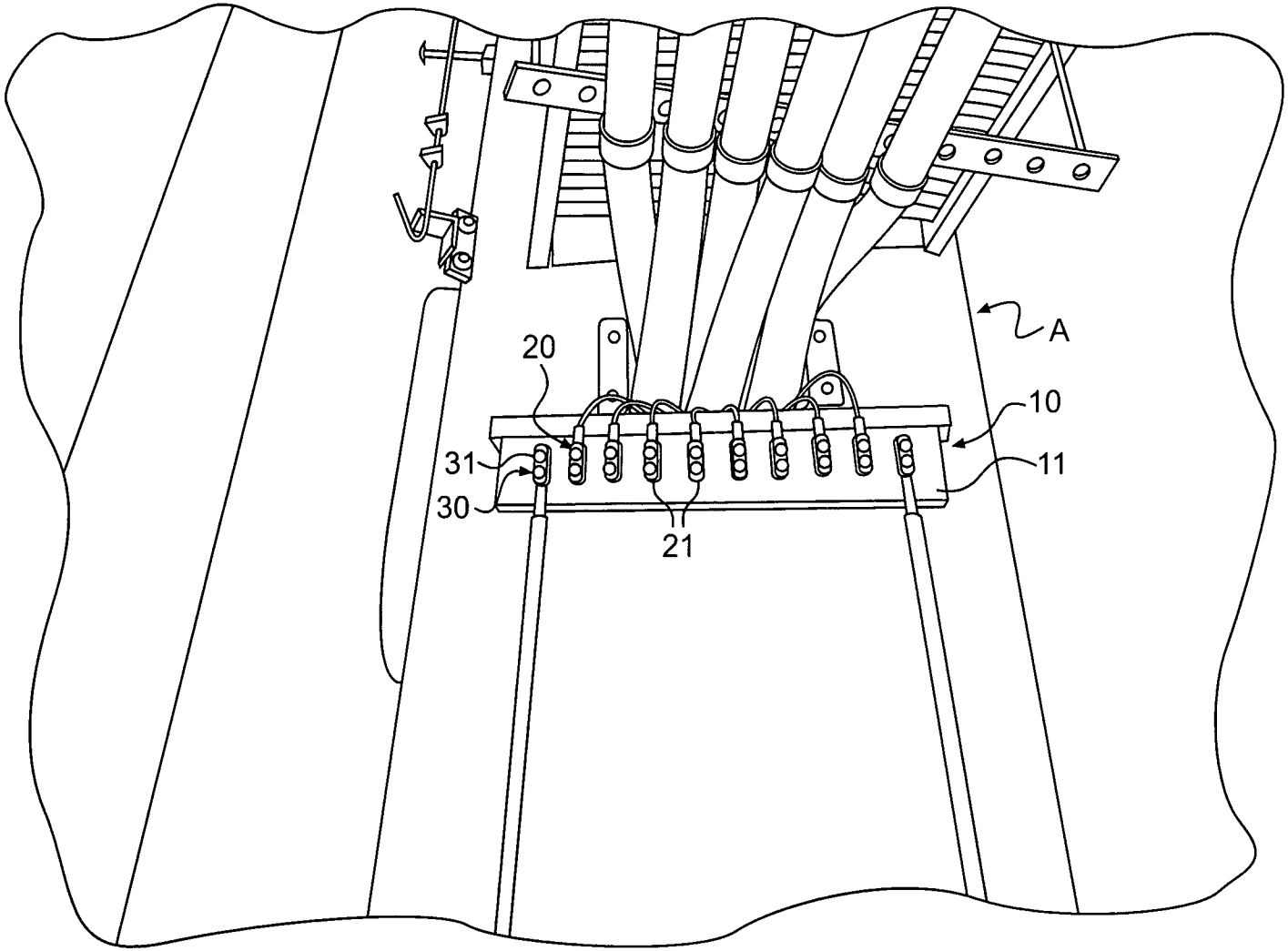
FIG. 1 PRIOR ART
FIG. 1 is a view of a conventional bus bar mounted on a cellular phone tower.

The present invention is a replacement bus system having one or more shafts supporting attachment lugs and one or more spacers that ride along the conductive shaft; the spacers are conductive and separate the attachment lugs. Although the present invention is not limited to grounding systems, for convenience of description it will be described in the context of a grounding system.

Wire lugs are terminal conductive electrical connectors; the lugs have a barrel end and a tang end. A terminal section of wire may be stripped to expose the conductor, which can then be crimped within the barrel of the lug, affixing the lug to the wire. The lug tang end includes a flat portion defining one or more bolt stud holes within it.

Such lugs are commonly used in electrical power or grounding applications. Conventional bus bars 10, as shown affixed to cellular telephone tower A in FIG. 1 and to building B in FIG. 2, support the lugs 20 and 30 in an orientation in which the lug tang ends 21 and 31 are parallel to the flat surface 11 of the bus bar 10. This enables fastening of the lug to the bus bar through the bolt stud holes (not shown) and separating the lugs to facilitate connection or disconnection.

Figure 3A:
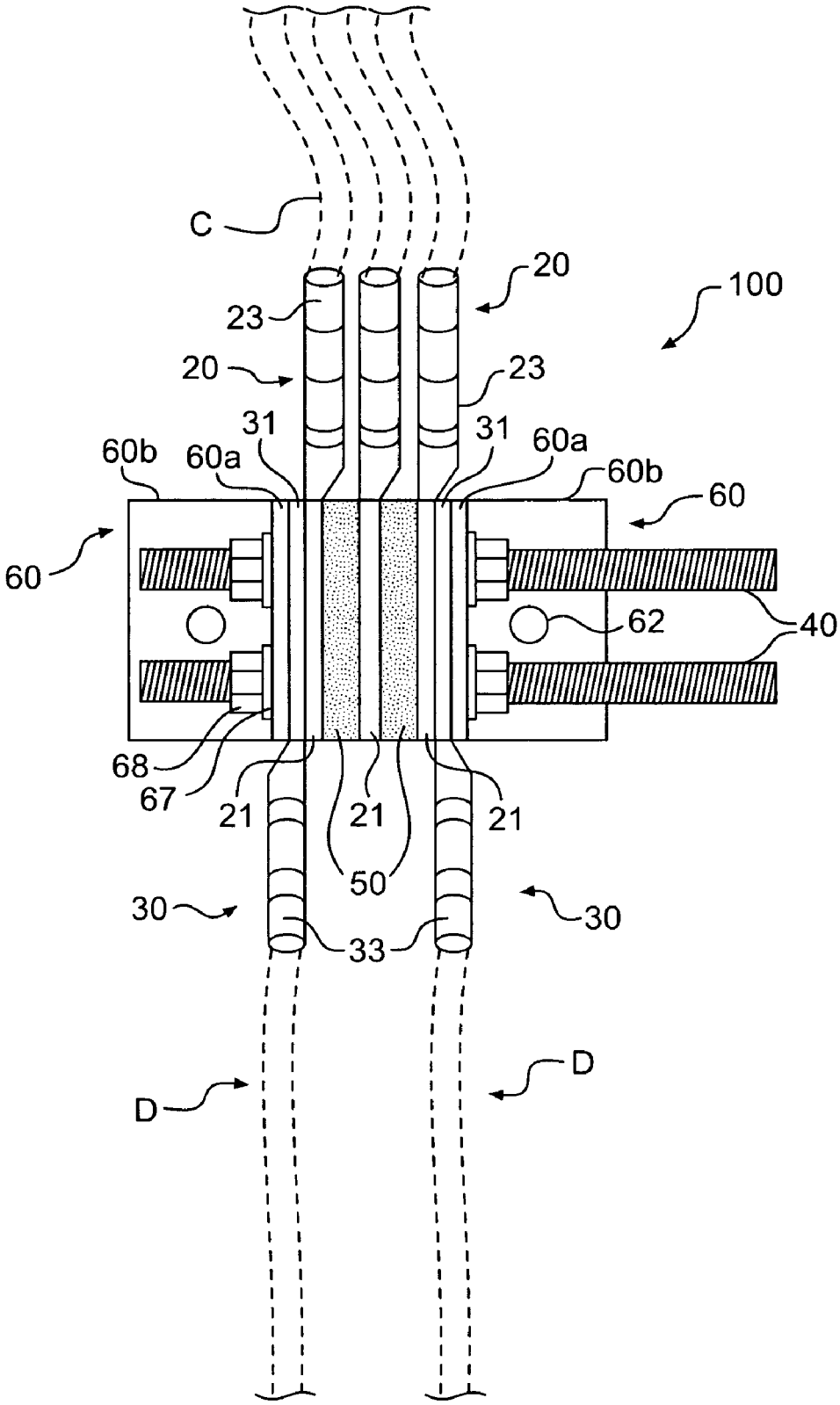
FIG. 3A illustrates an embodiment of the present invention.
Figure 4:
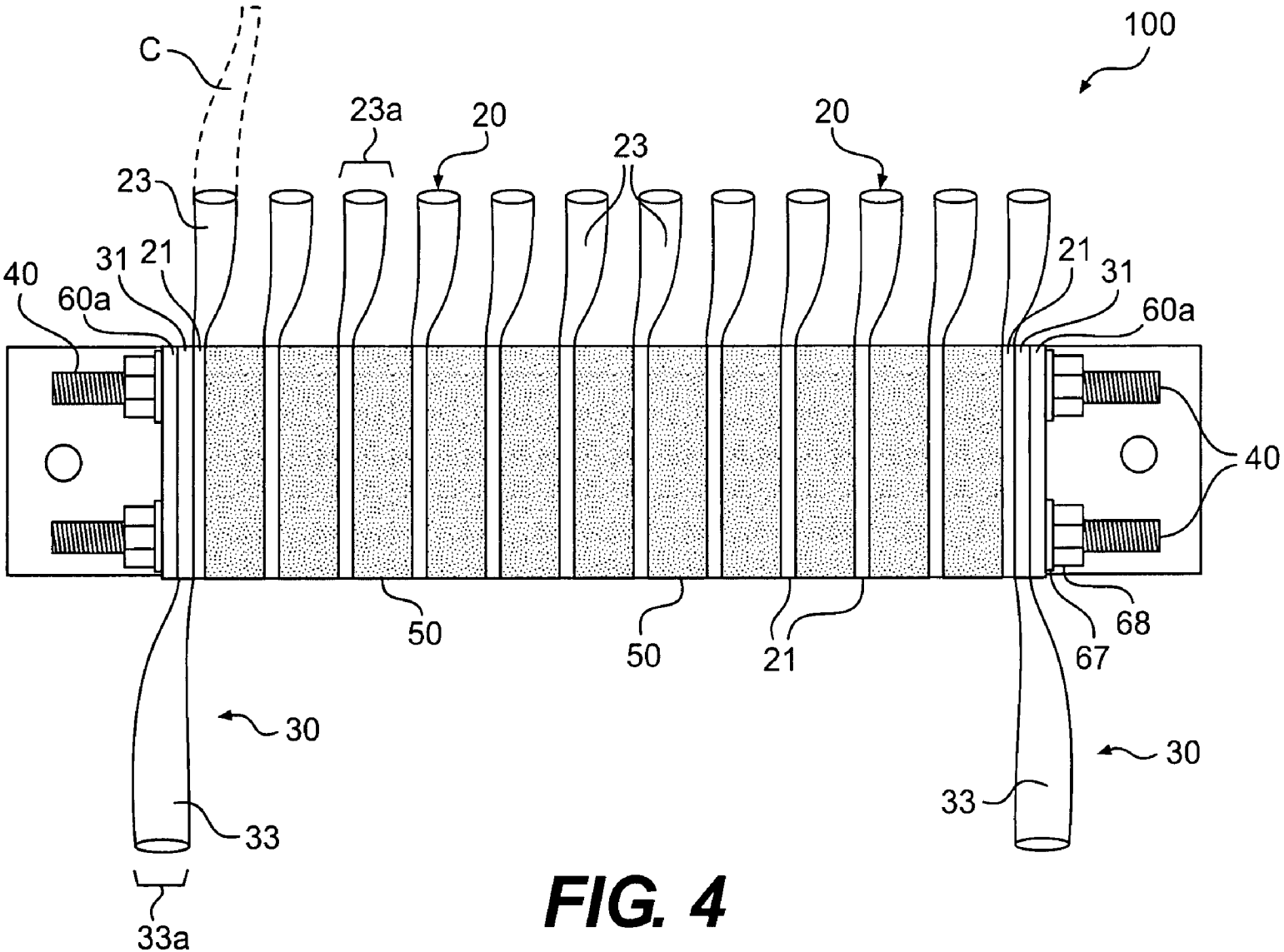
FIG. 4 shows an embodiment of the present invention.

As for the present invention, shown as system 100, with reference to FIGS. 3A and 4, one or more shafts 40 may be mounted in a desired location, interposed between the structure to be grounded and the earth grounding system. Generally, though not necessarily, one or more shafts will be parallel to a surface of the structure on which it is mounted. In FIG. 3A, a first set of lugs 20 is shown having barrel ends 23 attached to ground kits C, and a second set of lugs 30 is shown having barrel ends 33 attached to wires D which are attached to an earth grounding system (not shown). Lugs 20 and 30, which may have the same or different dimensions, ride along one or more shafts 40, which also may have the same or different dimensions. Lugs 20 have tang ends 21 and lugs 30 have tang ends 31. Tang ends 21 and tang ends 31 may have the same or different dimensions. Barrel ends 23 and 33, which also may have the same or different dimensions, have widths 23*a* and 33*a*, respectively (see FIG. 4). As noted above, the tang ends 21 and 31 of lugs 20 and 30, respectively, each define one or more stud holes 22 and 32 (not shown in FIG. 3A; see FIG. 4A), respectively, that correspond to or have shapes and sizes larger than those of the cross section profile 41 (not shown in FIG. 3A; see FIG. 10) of shafts 40. Of course, the cross section profile 41 of shafts 40 may be a variety of shapes and sizes, so long as the lug stud holes 22 and 32 have a complementary shape or larger shapes and sizes. For an embodiment adapted to use No. 6 standard lugs, for example, two steel shafts with a round cross section having ⅜" diameter would mate well. Preferably, but not necessarily, shafts 40 are threaded.

As shown in FIGS. 3A and 4, the two sets of lugs 20 and 30 may have different numbers of lugs in each set. Thus, each lug set may have only two or three lugs as shown in FIG. 3A (or even a single lug), or a greater number as shown for the set of lugs 20 in FIG. 4. In other embodiments of the invention, one of which is discussed in more detail below, only one set of lugs is present. The present invention facilitates the use of whichever number of lugs is appropriate for the application for which system 100 is intended.

Figure 4A:
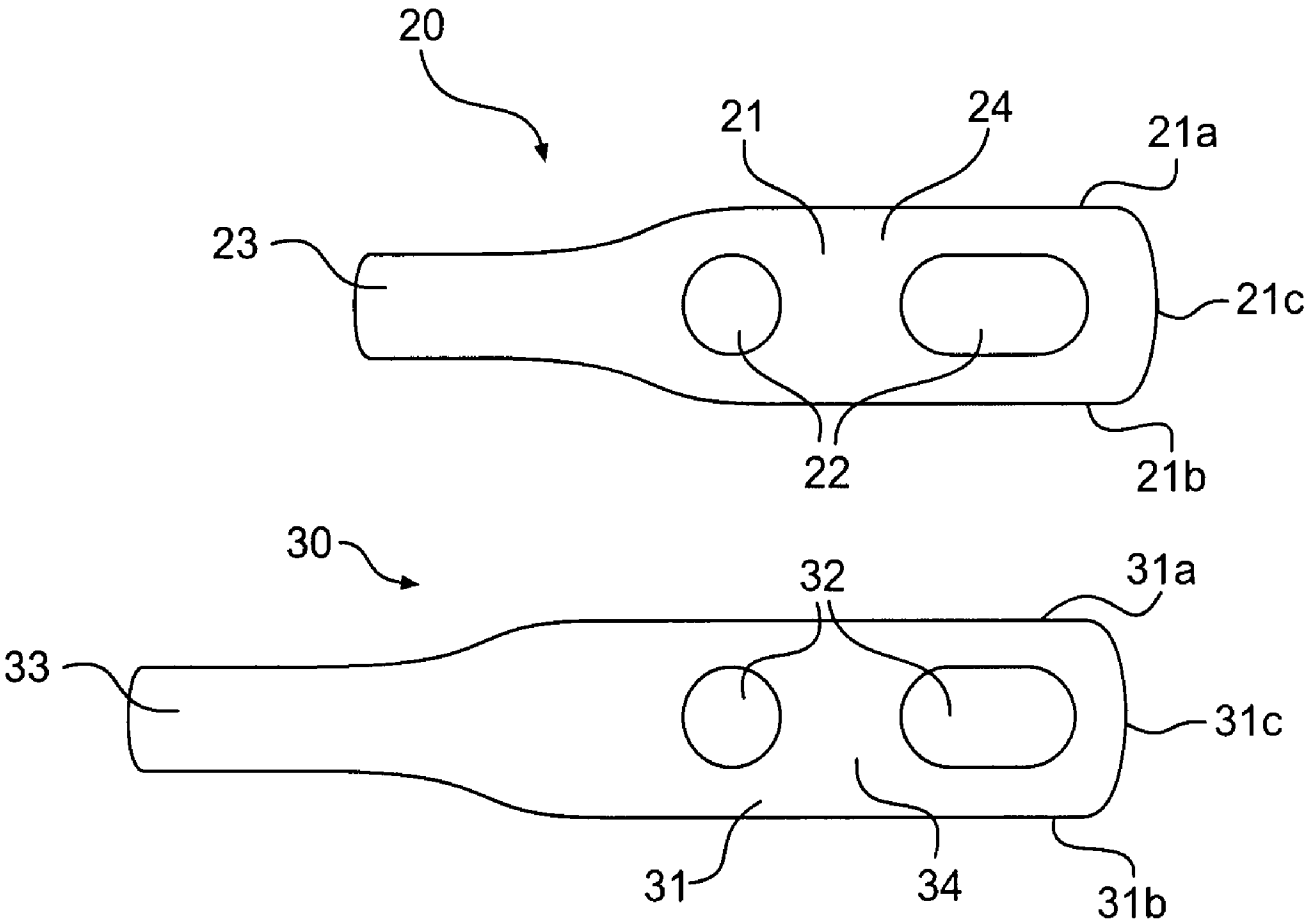
FIG. 4A depicts two lugs suitable for use with the present invention.

Two depictions of commercially available lug types are shown in FIG. 4A. Lug 20 shown in FIG. 4A corresponds to a standard #6 stranded slotted long barrel compression lug. Lug 30, slightly longer than lug 20, corresponds to a standard #2 stranded slotted long barrel compression lug. Additional commercially available lug types, including but not limited to standard #2 solid slotted long barrel compression lugs, are also known to the skilled artisan and may also be used as part of the present invention.

The tang end 21 of lug 20 has two flat surfaces 24 (one shown in FIG. 4A, the other not visible) and also has edges 21*a*, 21*b*, and 21*c*. Similarly, the tang end 31 of lug 30 has two flat surfaces 34 (one shown, the other not visible) and has edges 31*a*, 31*b*, and 31*c*. Barrel ends 23 and 33 of lugs 20 and 30, respectively, are cylindrical or shaped in another fashion that permits connection to a wire.

Figure 4C:
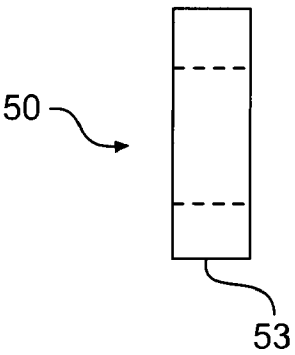
FIGS. 4B through 4D illustrate an embodiment of a spacer suitable for use with the present invention.
Figure 4B:
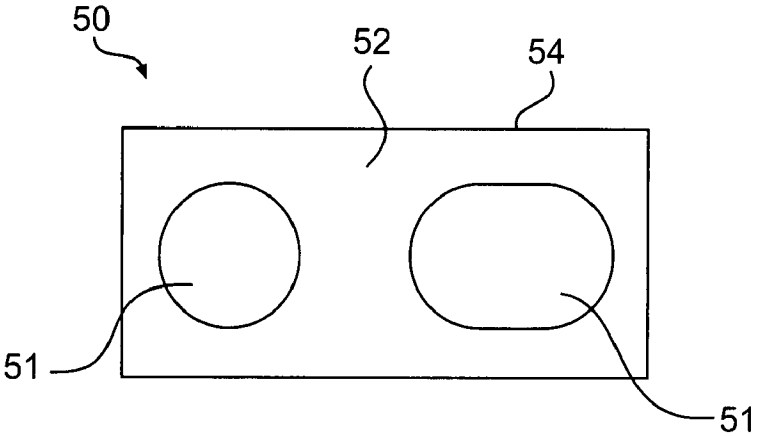
Figure 4D:
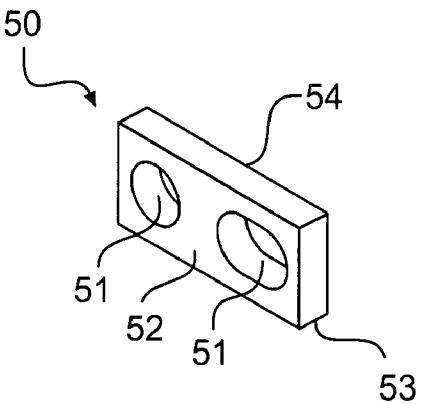

FIGS. 4B, 4C, and 4D are an illustration of an embodiment of the spacer 50 of the present invention. Three views of spacer 50 are shown, with the front view of FIG. 4B showing two spacer holes 51, each of which is capable of receiving a shaft. In the illustrated embodiment, spacer holes 51 have different sizes, but holes of the same size may also be used. Shapes other than those shown in FIG. 4B may also be used. Spacer 50 has two contact surfaces 52 (one of which is visible in FIGS. 4B and 4D; the other is not visible). Each contact surface 52 may contact a tang end of a lug, a mounting mechanism, a locking mechanism, or another spacer when installed in systems of the present invention, for example, the system 100 shown in FIG. 4. In one embodiment of the invention, the length of spacer edge 54 is at least as long as tang end edges 21*a*, 21*b*, 31*a*, and 31*b* (see FIG. 4A). Such an arrangement improves the quality of the electrical contact of the spacer with the lugs.

FIG. 4C illustrates the thickness of spacer 50, which is defined by the length of spacer edge 53. In some embodiments, the length of spacer edge 53 is at least as long as the widths 23*a* of barrel ends 23, and/or than the widths 33*a* of barrel ends 33 (see FIG. 4). Such a length helps ensure that the barrel ends 23 do not strike each other and/or that the barrel ends 33 do not strike each other. In another embodiment, the length of spacer edge 53 is a quarter of an inch. Such a length provides sufficient thickness for spacer 50 to protect a bus bar system from the arcing effects associated with a lightning strike. Such a length also provides a spacer 50 that is sufficiently thin to permit spacer holes 51 (edges of which are shown in dashed lines in FIG. 4C) to be formed in spacer 50 by using a punch press, which improves the efficiency of the process for manufacturing spacer 50.

Returning to FIG. 3A, lugs 20 and 30 ride along shafts 40, separated by spacers 50. Spacers 50 also include one or more spacer holes 51 (see FIGS. 4B and 4D) that correspond to the stud holes 22 and 32 (see FIG. 4A) of the lugs 20 and 30 or have shapes and sizes larger than the shapes and sizes of the cross sections of the shafts 40. In this embodiment, spacers 50 enable a 180-degree angle between the first set of lugs 20 and the second set of lugs 30. Shafts 40 may be mounted to a structure using a mount, as desired, shown here by substantially L-shaped mounting mechanism 60. Mounting mechanism 60 (in this case a substantially L-shaped bracket) may have a first end 60*a* that defines receiving holes 61 (not visible in FIG. 3A; see FIGS. 5B and 5D) adapted to receive one or more shafts 40. Mounting mechanism 60 also may have a second end 60*b* that includes mounting hole 62, which can be used with a locking mechanism (not shown) to secure mounting mechanism 60 to a desired surface. The first end 60*a* is adapted to position the shafts 40 in a desired configuration away from the surface. A variety of other mounting mechanisms may be used, however, including rail mounts, hangers, hinged systems, ceramic insulators, or panel mounting systems. The lugs 20 and 30 and spacers 50 may be secured or retained in place on the one or more shafts 40 by one or more locking mechanisms. For an embodiment in which one or more shafts 40 are threaded, this may be achieved using one or more nuts 68 and one or more washers 67 to secure lugs 20 and 30 and spacers 50 onto shafts 40.

Figure 2:
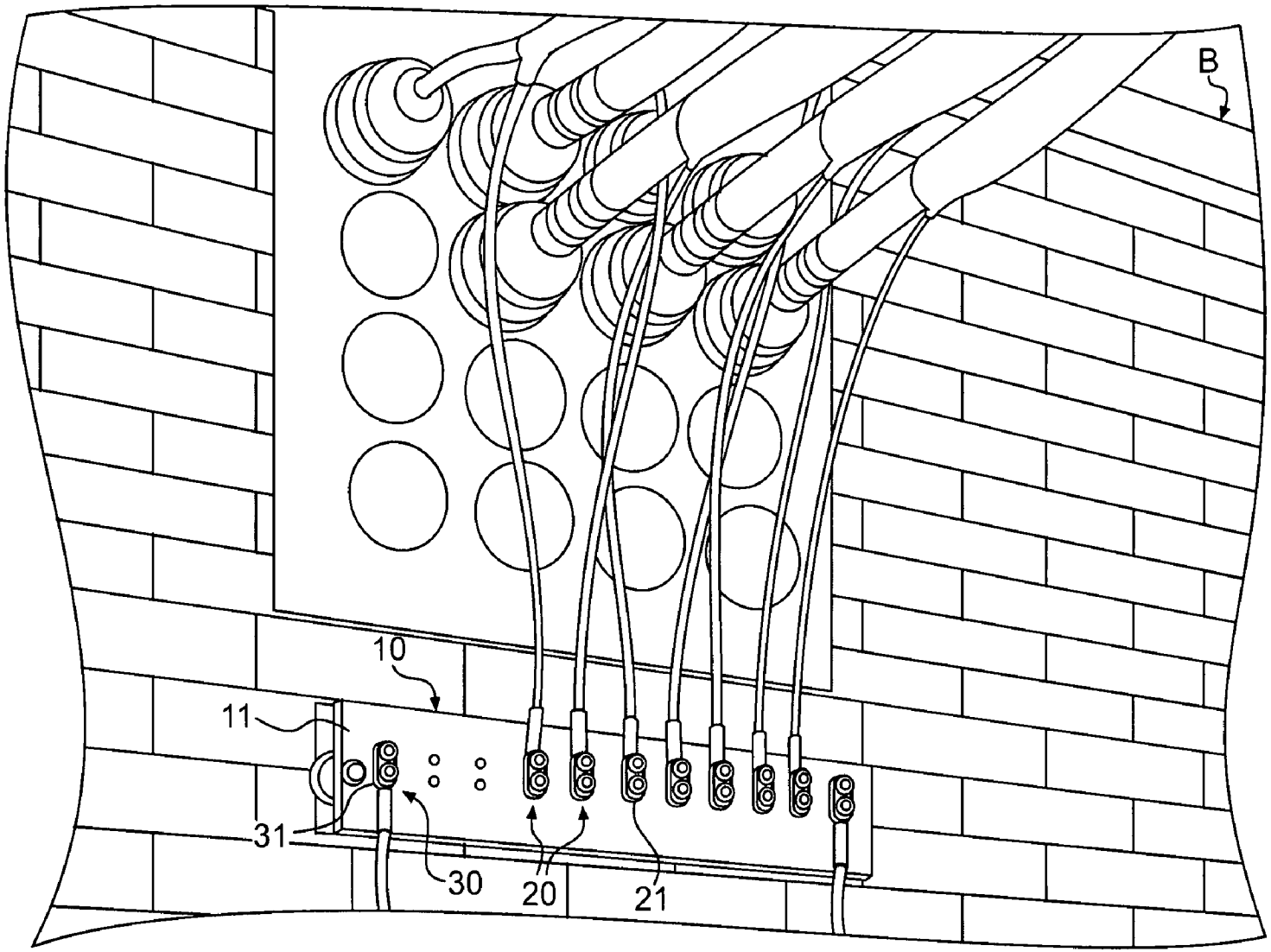
FIG. 2 PRIOR ART
FIG. 2 is a view of a conventional bus bar mounted on a building.

As may be seen in FIG. 3A, lugs 20 and 30 are configured transversely to the conventional approaches shown in FIGS. 1 and 2. In the configuration shown in FIG. 3A, the flat surfaces 24 and 34 (not visible in FIG. 3A; see FIG. 4A) of the tang ends 21 of lugs 20 and tang ends 31 of lugs 30 lie in different planes that are substantially parallel to one another, but substantially perpendicular to shaft 40. In contrast, the conventional approaches shown in FIGS. 1 and 2 configure the tang end flat surfaces in substantially the same plane. The configuration of the present invention enables a greater number of wires C to be connected over a given length of shaft 40. However, it has been discovered that this orientation creates problems for the connection of lugs 20 and 30 to the one or more shafts 40; in particular, when lugs 20 and 30 ride shafts 40 adjacent to each other, the barrel ends 23 of lugs 20 may strike each other and/or the barrel ends 33 of lugs 30 may strike each other, interfering with the electrical contact of the tangs and shafts. Spacer 50 solves this problem by enabling stacking or sandwiching of lugs 20 and 30 along shaft 40 with a spacer 50 between lugs 20 and 30 (though not necessarily on a one-to-one basis) and substantially perpendicular to shaft 40, providing both electrical contact and secure assembly. Arranged in sandwich fashion, flat surfaces 24 and 34 of tang ends 21 and 31, respectively, of lugs 20 and 30, respectively, are in different planes that are substantially parallel to each other, but substantially perpendicular to shaft 40. Contact surfaces 52 (not visible in FIG. 3A; see FIGS. 4B and 4D) of spacers 50 are also in substantially parallel planes when arranged in sandwich fashion and are substantially perpendicular to shaft 40. Two or more spacers 50 may be placed next to one another in the sandwich arrangement, in which case they are functionally equivalent to a single spacer having the combined thickness of the multiple spacers. Wires D may run in the opposite direction from ground kits C or other desired direction to reach the earth ground dissipation system (not shown).

Figure 3B:
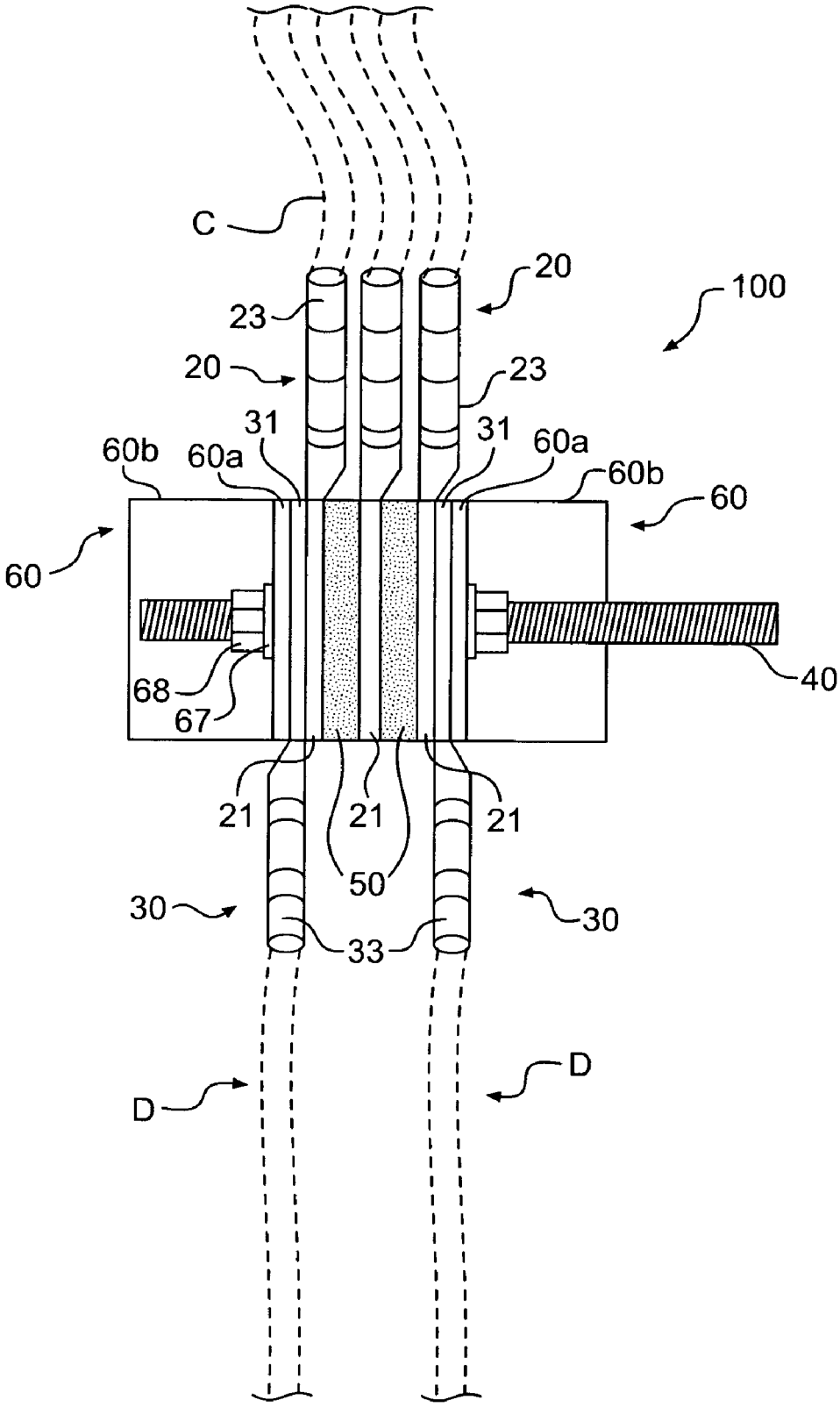
FIG. 3B illustrates an embodiment of the present invention.

A further advantage of this orientation over conventional bus bars 10 is that lugs 20 and 30 may be configured over the full range of angles available for the mounted one or more shafts 40. In most embodiments wherein one or more shafts 40 are mounted on a flat surface, there may be 180 degrees available for orientation. For example, it may be desirable for the first set of lugs 20 to connect to shafts 40 from above and for the second set of lugs 30 to connect to shafts 40 at an angle 90-degrees relative. Of course, the number of one or more shafts 40 and the configuration of lugs 20 and 30 should be suited to the desired angle; for two-holed lugs 20 and 30 configured with a 90-degree angle, it may be desirable to provide three shafts 40. Of course, in embodiments in which lugs 20 and 30 have only a single hole 22 and 32, respectively, they may ride a single shaft 40. FIG. 3B shows one embodiment of the invention using only a single shaft. As shown in FIG. 3B, the lugs may be positioned at a 180-degree angle. But in this and other embodiments having a single shaft and in which only one stud hole is present in each lug, the lugs may also be configured at a wide variety of angles. In any such embodiment, the profile of spacers 50 may be adapted to the desired angle to ensure secure abutment and electrical contact between lugs 20 and 30, and between the one or more shafts 40.

As noted above, this configuration also enables much of the structure of system 100 to be manufactured from stainless steel. Preferably, however, spacers 50 may be manufactured from tinned copper for improved conductivity among the lugs 20 and 30. However, a variety of conductive materials may be acceptable, depending on the embodiment. Different thicknesses of tin or other metal finish may be used. In one embodiment, the finish thickness may range from 0.0001 to 0.0003 inches. Another aspect of the invention is that the size of spacers 50 may be varied to accommodate the anticipated current, along with the type of lugs 20 and 30 selected for termination.

Figure 5C:
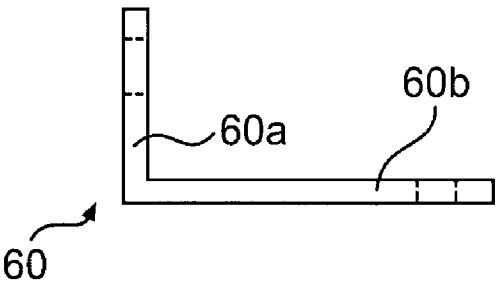
FIGS. 5A through 5D illustrate various views of an embodiment of a mounting mechanism suitable for use with the present invention.
Figure 5D:
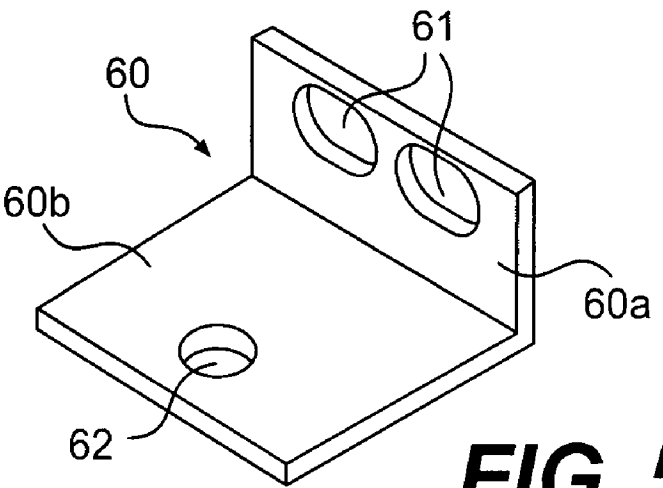
Figure 5A:
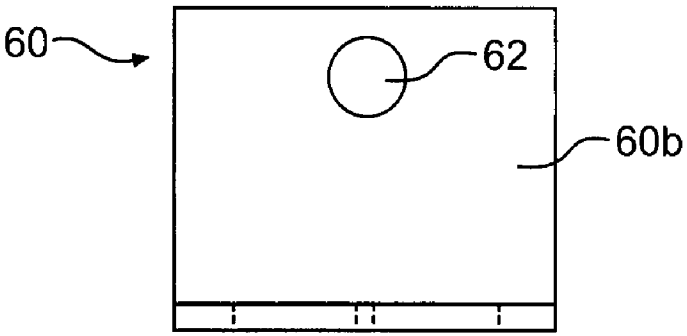
Figure 5B:
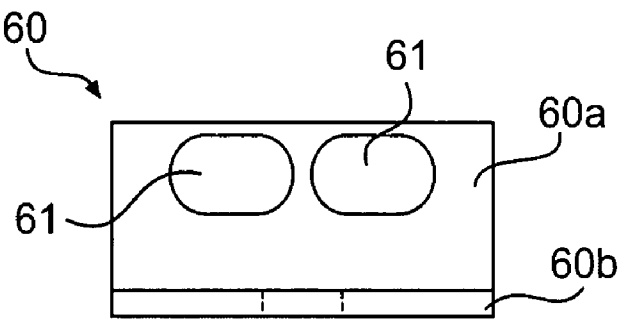

FIGS. 5A through 5D illustrate various views of an embodiment of the mounting mechanism 60 of the present invention. Mounting mechanism receiving holes 61, located in first end 60*a*, and mounting hole 62, located in second end 60*b*, are shown in FIGS. 5A, 5B, and 5D. Mounting mechanism mounting hole 62 may be used to secure mounting mechanism 60 to a surface by inserting an appropriate securing member through mounting hole 62 and into the surface. Mounting mechanism receiving holes 61 are sufficiently large to receive shafts 40. Other shapes for receiving holes 61 and mounting hole 62 may also be used. As shown in FIGS. 5A through 5D, mounting mechanism 60 may be a substantially L-shaped bracket, but other types of mechanisms may also be used.

Figure 6:
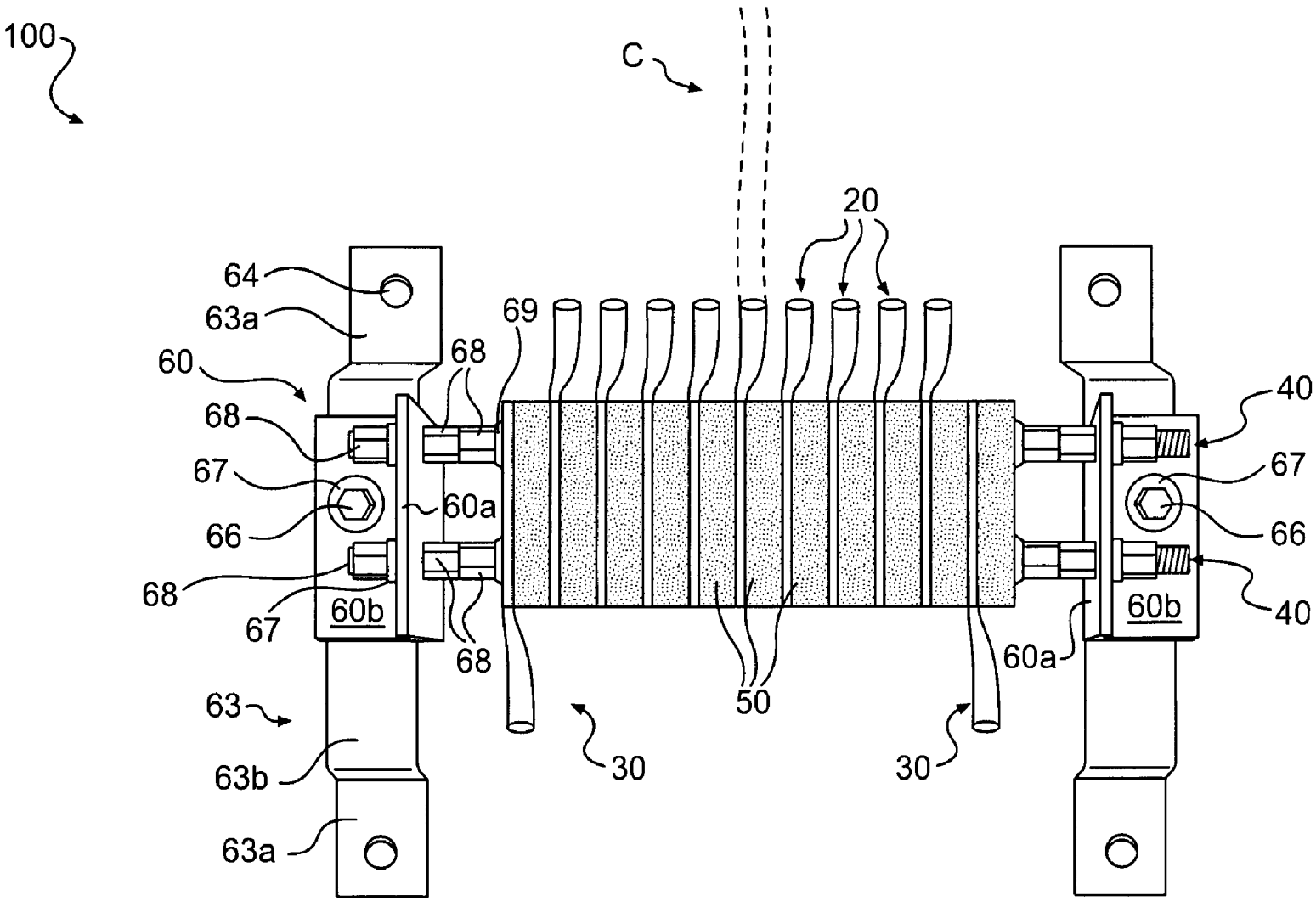
FIG. 6 illustrates an embodiment of the present invention.

FIG. 6 shows an additional embodiment of the present invention. In this embodiment, mounting mechanism 60 is not attached directly to a surface but instead is connected to a second mounting mechanism 63, shown in FIG. 6 as a substantially U-shaped wall bracket, capable of affixing system 100 to a wall or other surface. Second mounting mechanism 63 has one or more attaching surfaces 63*a* that define attaching holes 64 and a securing surface 63*b* that defines a securing hole 64*a* (not visible in FIG. 6; see FIG. 7B). To affix system 100, an appropriately sized bolt, screw, or other suitable securing member (not shown) is inserted through attaching holes 64 into the wall or other surface. Mounting mechanism 60 is secured to second mounting mechanism 63 by a screw 66, which is inserted through mounting mechanism 60 through mounting mechanism mounting hole 62 (not visible in FIG. 6; see FIGS. 5A and 5D), securing hole 64*a*, and washer 67. A nut and another washer (not visible in FIG. 6) complete the securing of the mounting mechanism 60 to the second mounting mechanism 63. Mounting mechanism 60 has two receiving holes 61 (not visible in FIG. 6; see FIGS. 5B and 5D) through which shafts 40 pass. Shafts 40 are secured to mounting mechanism 60 by nuts 68 and washers 67.

In FIG. 6, nine lugs 20 are shown, one of which is connected to ground kit C. Two lugs 30 are shown. Those lugs are capable of being connected to a wire leading to an earth grounding system (not shown). Lugs 20 and 30 are arranged on shafts 40, with spacers 50 present between the lugs to prevent direct contact between them. Belleville washers 69 are shown between one of the lugs 30 and two of the nuts 68. The preferably non-flat Belleville washers 69 help the system 100 adjust to thermal expansions associated with lightning strikes or other electrical surges, thereby maintaining electrical continuity between the lugs 20 and 30 and spacers 50. Other types of washers may be used, however, in place of Belleville washers 69. The use of two nuts 68 for each shaft 40 in this exemplary embodiment instead of a single nut between Belleville washer 69 and mounting mechanism first end 60*a* also helps manage thermal expansions.

Figure 7:
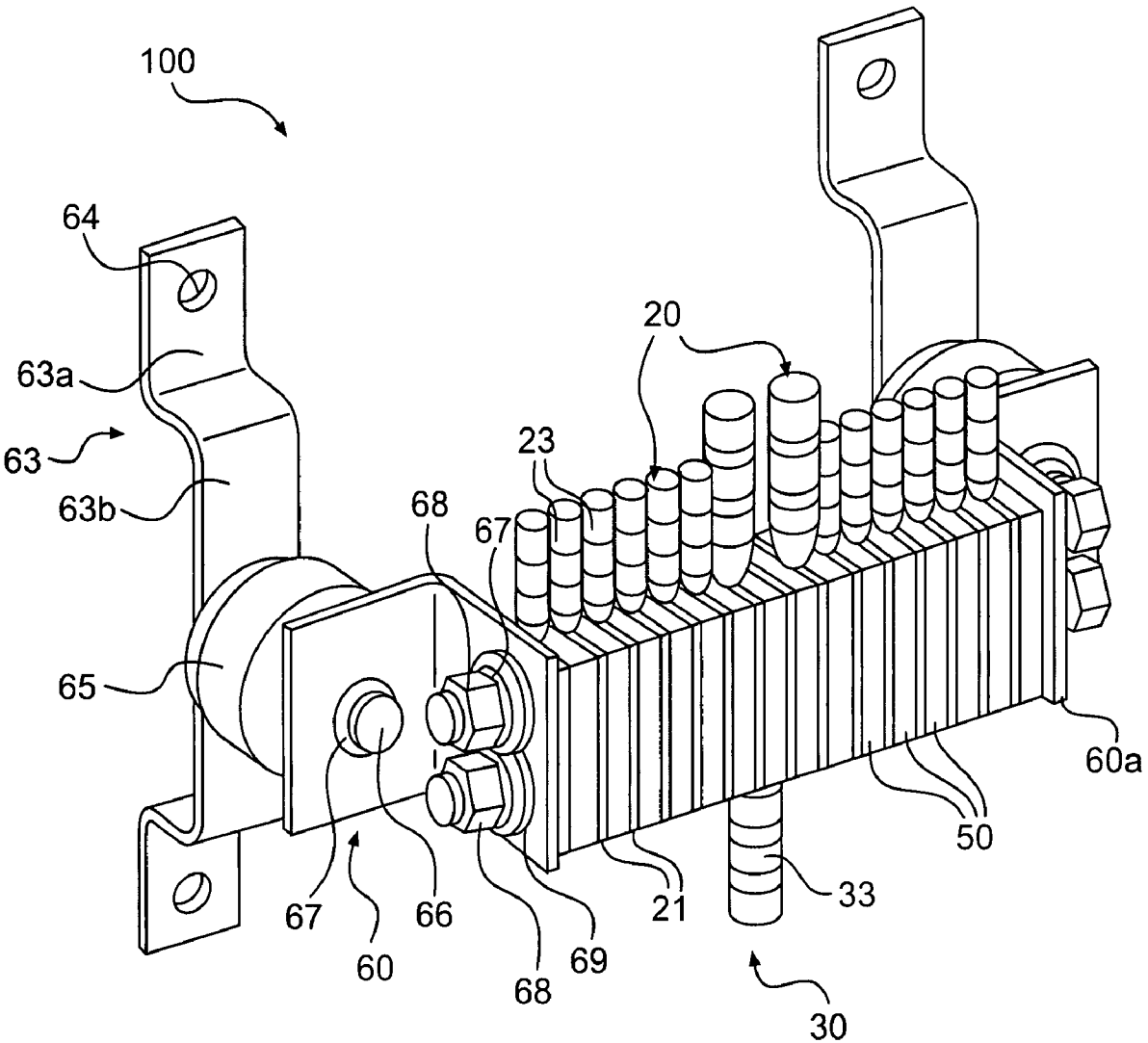
FIG. 7 illustrates another embodiment of the present invention.

FIG. 7 shows another embodiment of the present invention. In this embodiment, fourteen lugs 20 are shown in the top set of lugs, two of which, shown in the middle of the set, are of a larger size than the rest. Many combinations of lug sizes are able to be used with the invention. The second set of lugs is a single lug 30. FIG. 7 also shows insulator 65 secured between mounting mechanism 60 and second mounting mechanism 63 by screw 66 and washer 67. Insulator 65 may be, for example, a commercially available ground bar insulator suitable for the environment in which system 100 will be used.

Figure 7A:
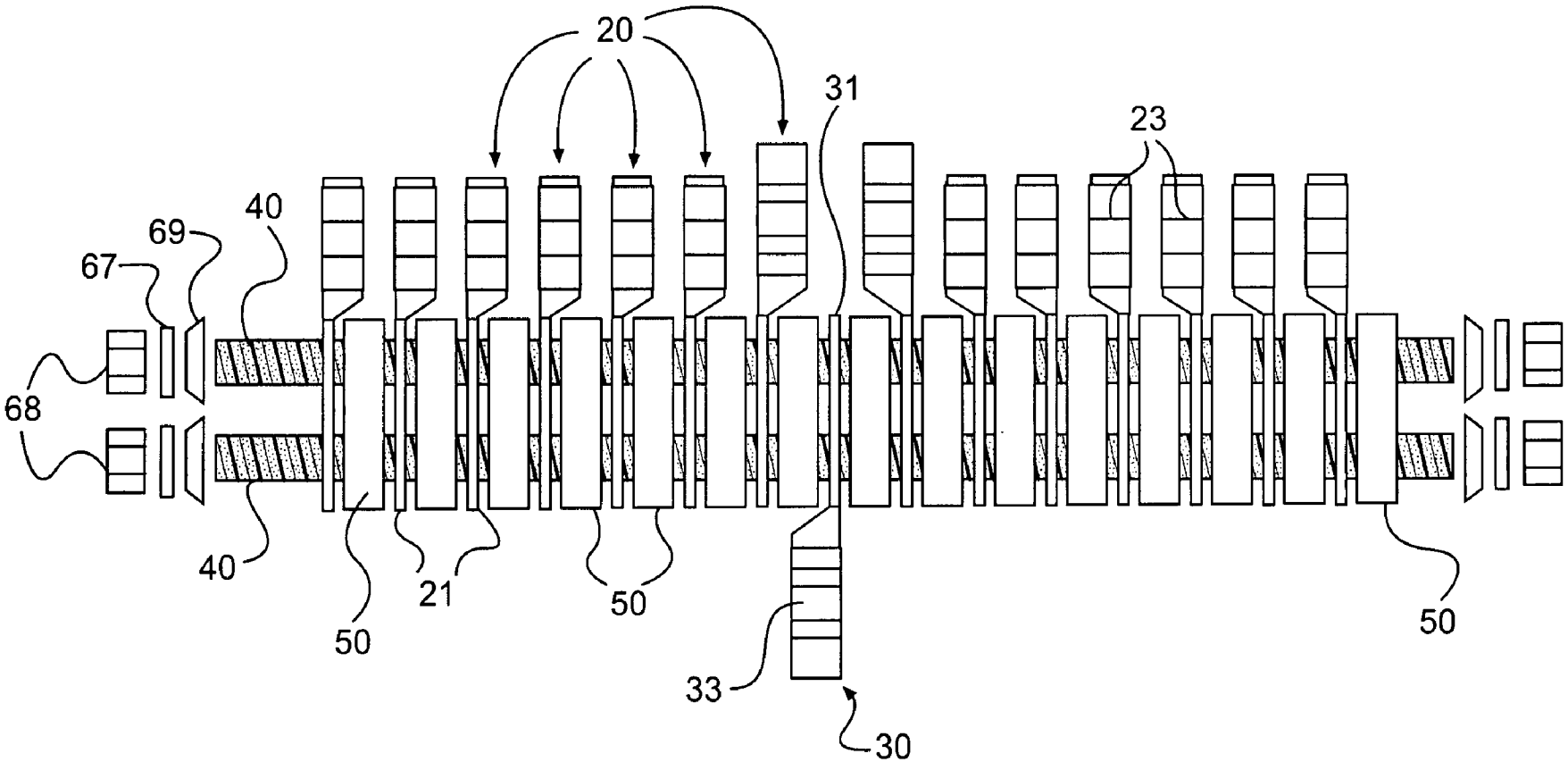
FIG. 7A is a partially exploded view of portions of the embodiment of the invention shown in FIG. 7.

FIG. 7A shows a partially exploded view of some of the components shown in FIG. 7. As shown in FIG. 7A, spacers 50 are generally arranged between the tang ends 21 and 31 of lugs 20 and lug 30, respectively. In this illustration, the spacer 50 closest to the right end of shafts 40 would abut a single lug when the components are secured. A spacer 50 at one of the ends of the series of lugs and spacers may also abut a mounting mechanism 60 (not shown in FIG. 7A; see FIG. 7).

Figure 7B:
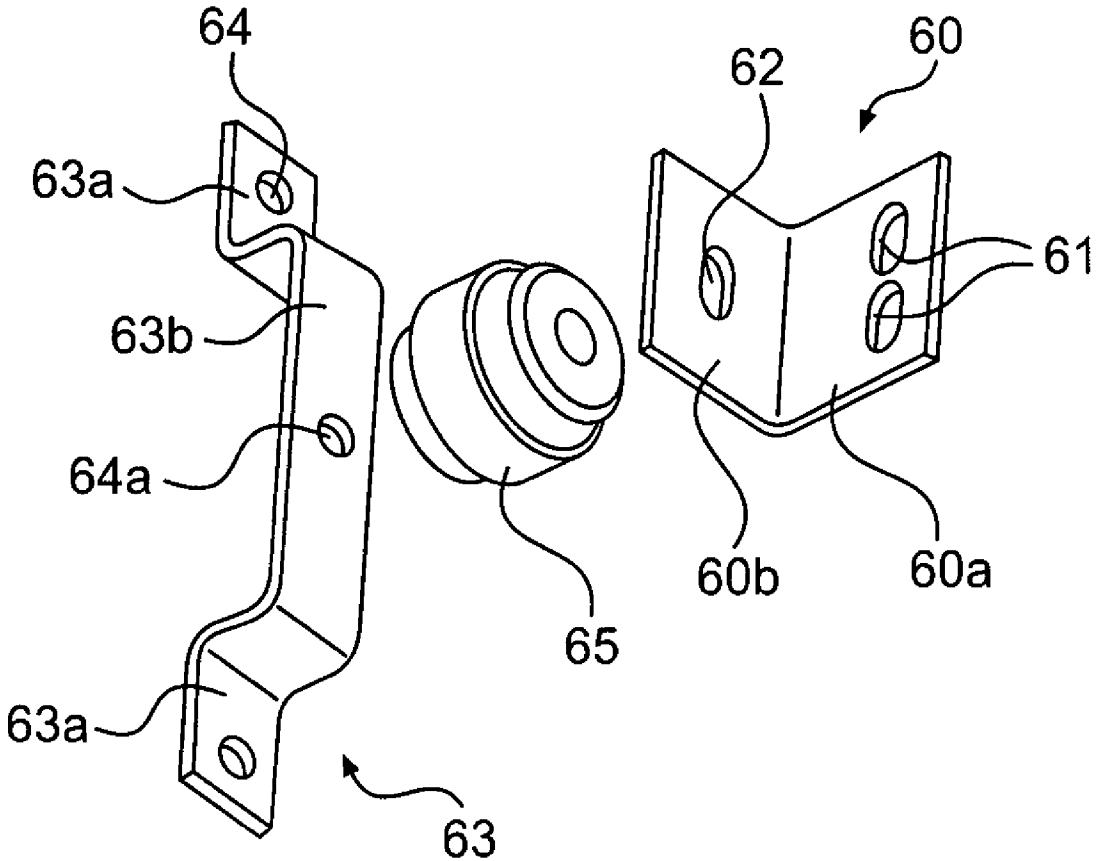
FIG. 7B is an exploded view of portions of the embodiment of the invention shown in FIG. 7.

Returning to FIG. 7, mounting mechanism 60, insulator 65, and second mounting mechanism 63 provide a means for securing the system 100 to a surface. FIG. 7B shows these three components separately in an exploded view. These components are exemplary; other types of components may also be used, and fewer or more than three components (or none at all, as discussed below) may be used to secure the system 100 as desired.

Figure 8:
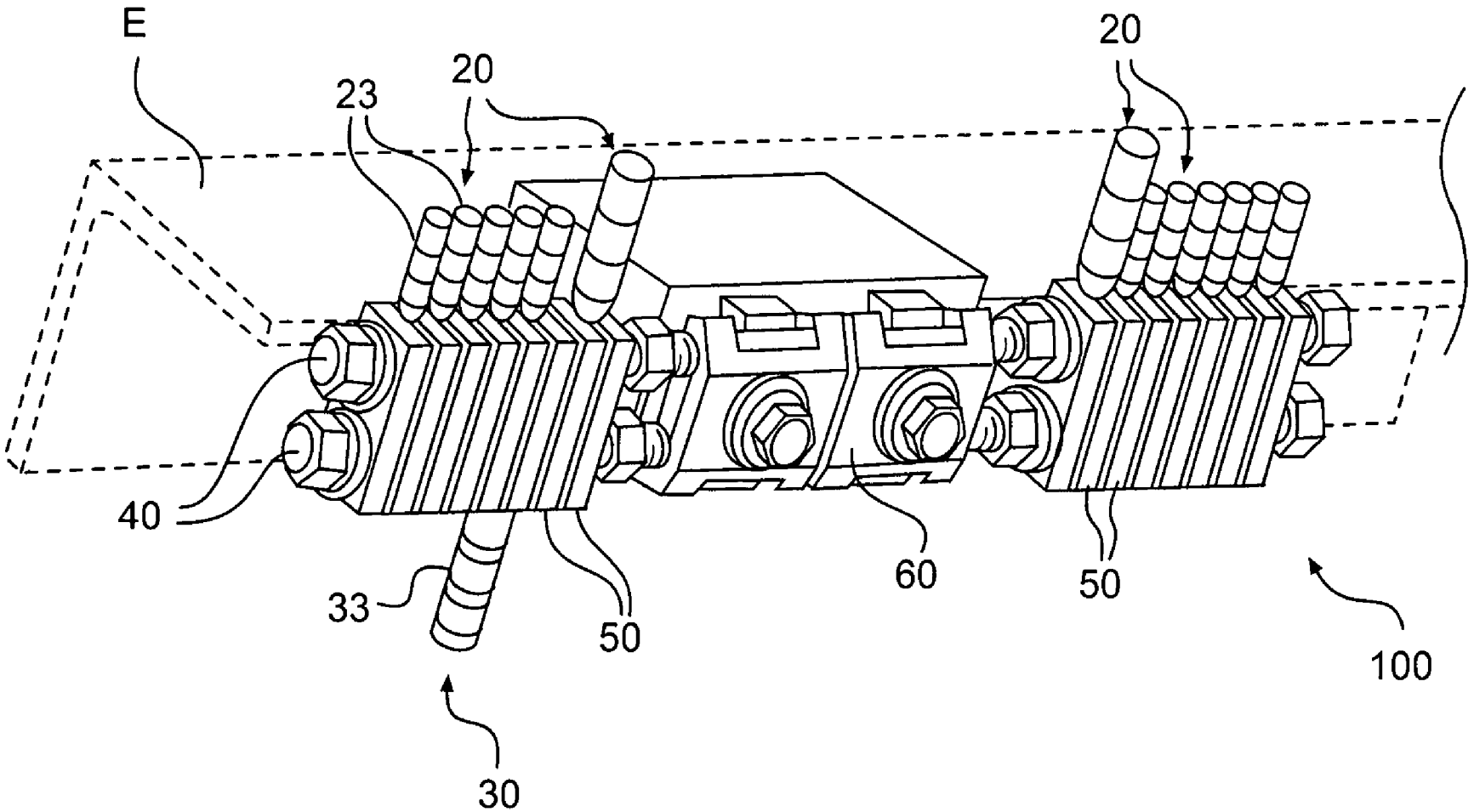
FIG. 8 illustrates another embodiment of the present invention mounted on a panel.

FIG. 8 shows another embodiment of the present invention. In this embodiment, mounting mechanism 60 is secured to shafts 40 in the middle and separates lugs 20 and spacers 50 into two groups. Mounting mechanism 60 is shown as a bonding plate capable of receiving shafts 40 and affixing system 100 to a structure, shown as panel E. Such an embodiment may be useful for installing system 100 on a panel attached to a tower such as a cellular telephone tower. The system 100 may also be affixed to other types of structures using this embodiment.

Figure 9:
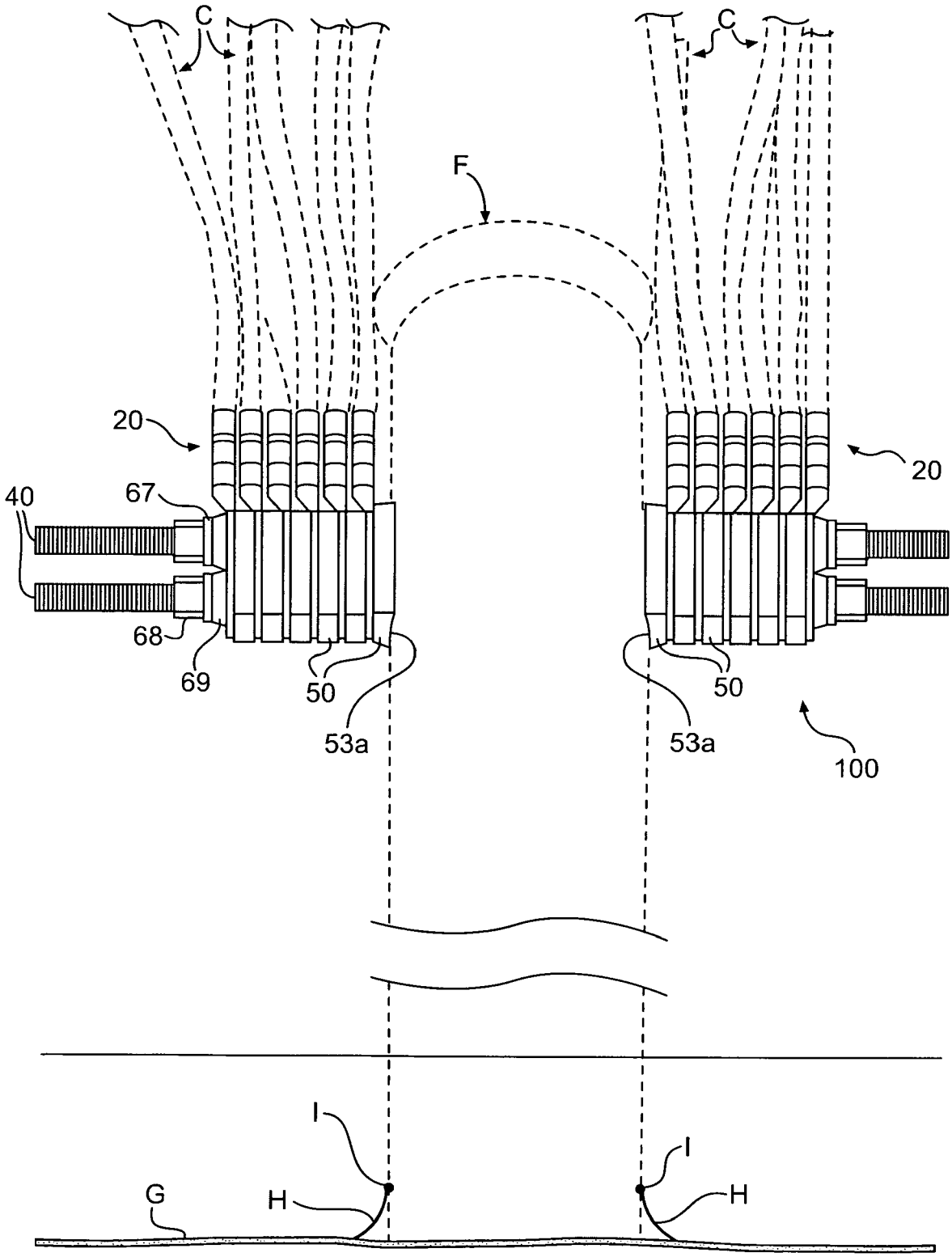
FIG. 9 illustrates another embodiment of the present invention mounted on a pole.
Figure 9B:
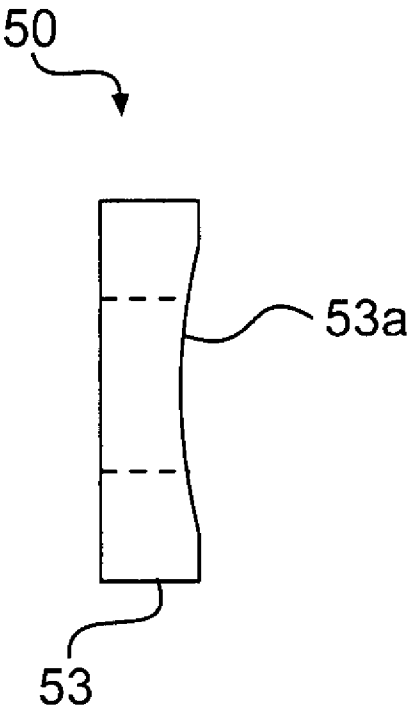
FIGS. 9A and 9B illustrate another embodiment of a spacer suitable for use with the present invention.
Figure 9A:
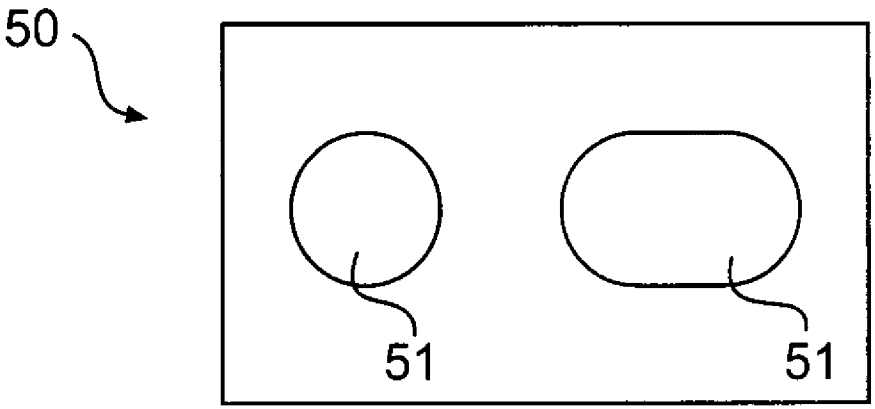

FIG. 9 shows another embodiment of the invention. In this embodiment, no type of mounting mechanism 60 is needed to affix the system 100 to the desired structure, in this case a pole F. Pole F may be, for example, a standard galvanized steel post, sometimes referred to as an ice bridge post. The shafts 40 are inserted through holes (not shown) in pole F, which places them in position to receive the other components of system 100, including lugs 20 and spacers 50. Washers 67 and nuts 68 secure the lugs 20 and spacers 50 to pole F, thereby securing system 100 in place. In order to ensure a good fit between the system 100 and pole F, the spacers 50 that abut the pole F each have a curved edge 53*a* as shown in FIG. 9B. Belleville washers 69 are also used in addition to washers 67. Ground kits C are shown attached to lugs 20. Shafts 40 are in electrical contact with pole F, which is connected to an earth grounding system G via connectors H, which are attached to pole F by exothermic welds I. In this arrangement, the pole F may be labeled as a dedicated surge grounding path.

The various systems 100 of the present invention may be used as part of a method for protecting a structure from electrical-surge damage caused by lightning or other effects. Such a method involves providing a system 100, affixing the system 100 to the structure one desires to protect, connecting the system 100 to one or more ground kits by attaching one or more wires of those ground kits to one or more lugs 20, and connecting the system 100 to an earth grounding system. Such a connection to the earth grounding system may be performed by attaching a wire from the earth grounding system to one or more lugs 30. Or the connection may exist directly between the earth grounding system and the shafts 40 as discussed above. The steps of these methods may be performed in the order listed above or in other orders. Such methods are useful for protecting structures in a variety of industrial areas, including communications systems. In one embodiment, the structure to be protected is a cellular telephone tower.

Figure 10:
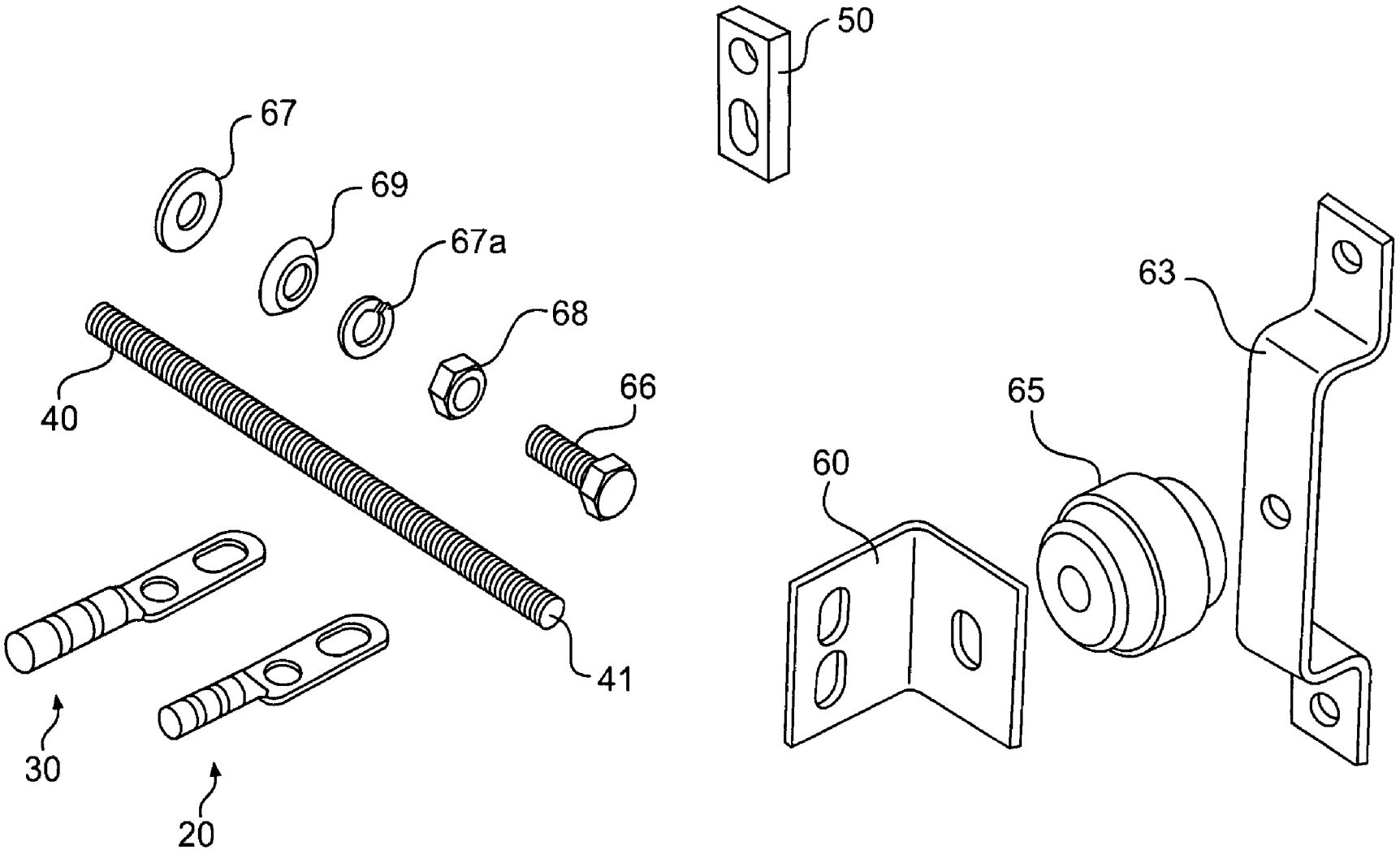
FIG. 10 illustrates components that may be used with the present invention.

Another embodiment of the invention is a kit in which parts needed to construct a system 100 are packaged in a single container. Suitable containers include, for example, bags, boxes, and plastic bins. Other types of containers typically used for retail sales could also be used. Such kits are useful for persons interested in assembling systems 100 and/or using them to protect structures that may be susceptible to lightning strikes or other forms of electrical-surge damage. FIG. 10 illustrates parts (not necessarily shown to scale) that may be included in such a kit, including lugs 20 and/or 30, shafts 40, spacers 50, mounting mechanisms 60, second mounting mechanisms 63, insulators 65, screws 66, washers 67 (some of which may be Belleville washers 69 and/or lock washers 67*a*), and nuts 68. Various combinations of some or all of these types of parts, and other related parts, may be placed into a container to provide a kit that is useful in the grounding and energy-dispersion-system arts. Spacers 50 may also be sold separately.

Thus, the instant invention provides an alternative to conventional bus bar systems. The systems of the invention provide a more efficient arrangement of lugs than the conventional systems. They also use less copper than conventional bus bar systems, thereby reducing financial incentives for theft of the system. The invention, which performs equivalently to a copper bus bar, is also versatile and permits a wide variety of components to be employed in it.

The above examples should be considered to be exemplary embodiments and are in no way limiting of the present invention. Thus, while the description above refers to particular embodiments, it will be understood that many modifications may be made without departing from the spirit thereof.

What is claimed is:

1. A bus system for connecting a first wire lug to a second wire lug, the first wire lug having a first barrel end and an opposing first tang end defining a first stud hole and the second wire lug having a second barrel end and an opposing second tang end defining a second stud hole, the bus system comprising:

an elongated shaft having a cross section and a desired length, wherein the shape and size of the cross section of the shaft are smaller than the shape and size of the first and second stud holes, so that the shaft is capable of passing through the first stud hole and the second stud hole such that the first lug and the second lug may be mounted onto the shaft with the shaft substantially perpendicular to the first and second tang ends;

a conductive spacer having a desired thickness and defining a spacer hole, wherein the shape and size of the spacer hole are larger than the shape and size of the cross section of the shaft, so that the shaft is capable of passing through the spacer hole such that the spacer may be mounted onto the shaft with the shaft substantially perpendicular to the spacer and with the desired thickness of the spacer oriented along the length of the shaft;

at least one locking mechanism having a locking surface, the locking mechanism adapted to engage the shaft at a desired location and to present the locking surface with an orientation substantially perpendicular to the shaft; and wherein the first wire lug, the second wire lug, and the spacer are capable of being mounted onto the shaft with the spacer interposed between and separating the first and second tang ends of the first and second wire lugs in sandwich fashion, with the shaft substantially perpendicular to the first and second tang ends, and the at least one locking mechanism may be engaged with the shaft such that the locking surface secures the wire lugs and spacer at a desired location and in electrical contact.

2. The bus system of claim 1 further comprising a mounting mechanism having a first end capable of being attached to the shaft and a second end capable of being affixed to a surface of a structure, the first end being adapted to position the shaft in a desired configuration away from the surface.

3. A bus system, comprising:

a plurality of wire lugs, each of said wire lugs having a barrel end and an opposing tang end, each of said tang ends of said wire lugs defining a pair of stud holes and having a desired length and each of said barrel ends having a desired width;

two elongated shafts, each of said shafts having a cross section and a desired length, wherein each of the cross sections has a shape and size smaller than the shapes and sizes of the pair of stud holes, so that the shafts are capable of passing through the pair of stud holes within the tang ends of each of the wire lugs so that the wire lugs may be mounted onto the shafts with the shafts substantially perpendicular to the tang ends of the wire lugs;

one or more conductive spacers, each of said one or more spacers having a desired thickness and a desired length and defining a pair of spacer holes, wherein the shapes and sizes of the spacer holes are larger than the shapes and sizes of the cross sections of the shafts, so that the shafts are capable of passing through the spacer holes such that the one or more spacers may be mounted onto the shafts with the shafts substantially perpendicular to the one or more spacers and the desired thickness of the one or more spacers oriented along the length of the shafts;

at least one locking mechanism having a locking surface, the locking mechanism adapted to engage the shafts at a desired location and to present the locking surface with an orientation substantially perpendicular to the shafts; and wherein the plurality of wire lugs and the one or more spacers are capable of being mounted onto the shafts in sandwich fashion, with the shafts substantially perpendicular to the tang ends of the wire lugs and substantially perpendicular to the one or more spacers and the at least one lacking mechanism may be engaged with the shafts such that the locking surface secures the wire lugs and one or more spacers at a desired location and in electrical contact.

4. The bus system of claim 3 further comprising a mounting mechanism having a first end capable of being attached to the shafts and a second end capable of being affixed to a surface of a structure, the first end being adapted to position the shafts in a desired configuration away from the surface.

5. The bus system of claim 3 further comprising:

a first mounting mechanism, said first mounting mechanism comprising a substantially L-shaped bracket having a receiving end and a mounting end;

a second mounting mechanism, said second mounting mechanism comprising a substantially U-shaped bracket having an attaching surface and one or more securing surfaces; and a second locking mechanism having a second locking surface; and wherein the receiving end of the substantially L-shaped bracket is capable of receiving the shafts and the mounting end of the substantially L-shaped bracket is capable of being attached to the attaching surface of the substantially U-shaped bracket, the one or more securing surfaces of the substantially U-shaped bracket are capable of being affixed to a surface of a structure, the substantially U-shaped bracket is adapted to position the substantially L-shaped bracket and the shafts in a desired configuration away from the surface, and said second locking mechanism is capable of securing said second mounting mechanism to said first mounting mechanism such that the second locking surface contacts at least one of the mounting end of the substantially L-shaped bracket and the attaching surface of the substantially U-shaped bracket.

6. The bus system of claim 5 further comprising an insulator, wherein said insulator is capable of being secured between said substantially L-shaped bracket and said substantially U-shaped bracket by said second locking mechanism.

7. The bus system of claim 3 wherein each of said one or more spacers each has a length at least as great as the lengths of said tang ends of said lugs.

8. The bus system of claim 3 wherein said shafts have a circular, cross section profile.

9. The bus system of claim 8 wherein said shafts are threaded.

10. The bus system of claim 9 wherein the locking mechanism comprises one or more nuts and one or more washers, wherein the one or more nuts and the one or more washers are formed to fit the threaded shafts, and wherein the locking surface is located on one or more of the washers.

11. The bus system of claim 10 wherein at least one of the washers is a Belleville washer.

12. The bus system of claim 3 wherein the shafts and the wire lugs are formed from stainless steel and the one or more spacers are formed from tinned copper.

13. The bus system of claim 3 wherein the plurality of lugs comprises a first set of one or more wire lugs and a second set of one or more wire lugs and the respective barrel ends of the first set of wire lugs and second set of wire lugs are at an angle of about 180 degrees.

14. The bus system of claim 13 wherein the first set of wire lugs has a greater number of wire lugs than does the second set of wire lugs.

15. The bus system of claim 14 wherein the length of each of the one or more spacers is at least as great as the lengths of said tang ends of said wire lugs and the thickness of each of the one or more spacers is at least as great as the widths of the barrel ends of the wire lugs in the first set of wire lugs.

16. The bus system of claim 13 wherein said shafts have a circular cross section profile.

17. The bus system of claim 16 wherein said shafts are threaded.

18. The bus system of claim 17 wherein the locking mechanism comprises one or more nuts and one or more washers, wherein the one or more nuts and the one or more washers are formed to fit the threaded shaft, and wherein the locking surface is located on one or more of the washers.

19. The bus system of claim 18 wherein at least one of the washers is a Belleville washer.

20. The bus system of claim 13 wherein the two shafts, the first set of one or more wire lugs, and the second set of one or more wire lugs are formed from stainless steel and the one or more spacers are formed from tinned copper.

21. A method of protecting electrical components attached to a structure from electrical-surge damage, comprising:

providing a bus system comprising:

a plurality of wire lugs, each of said wire lugs having a barrel end and an opposing tang end, each of said tang ends of said wire lugs defining a pair of stud holes and having a desired length and each of said barrel ends having a desired width;

two elongated shafts, each of said shafts having a cross section and a desired length, wherein each of the cross sections has a shape and size smaller than the shapes and sizes of the pair of stud holes, so that the shafts are capable of passing through the pair of stud holes within the tang ends of each of the wire lugs so that the wire lugs may be mounted onto the shafts with the shafts substantially perpendicular to the tang ends of the wire lugs;

one or more conductive spacers, each of said one or more spacers having a desired thickness and a desired length and defining a pair of spacer holes, wherein the shapes and sizes of the spacer holes are larger than the shapes and sizes of the cross sections of the shafts, so that the shafts are capable of passing through the spacer holes such that the one or more spacers may be mounted onto the shafts with the shafts substantially perpendicular to the one or more spacers and the desired thickness of the one or more spacers oriented along the length of the shafts;

at least one locking mechanism having a locking surface, the locking mechanism adapted to engage the shafts at a desired location and to present the locking surface with an orientation substantially perpendicular to the shafts; and wherein the plurality of wire lugs and the one or more spacers are capable of being mounted onto the shafts in sandwich fashion, with the shafts substantially perpendicular to the tang ends of the wire lugs and substantially perpendicular to the one or more spacers and the at least one locking mechanism may be engaged with the shafts such that the locking surface secures the wire lugs and one or more spacers at a desired location and in electrical contact;

affixing said bus system to said structure;

connecting one or more of the wire lugs to a grounding kit; and connecting the bus system to an earth grounding system.

22. The method of protecting electrical components attached to a structure from electrical-surge damage as claimed in claim 21, wherein the bus system further comprises a mounting mechanism having a first end capable of being attached to the shafts and a second end capable of being affixed to a surface of the structure, the first end being adapted to position the shafts in a desired configuration away from the surface, and wherein said mounting mechanism is used in the affixing step to affix the bus system to the structure.

23. The method of claim 21, wherein said structure is part of a communication system.

24. The method of claim 23, where said structure is a cellular telephone tower or is a structure attached to a cellular telephone tower.

25. A bus system installation kit, comprising:

a plurality of wire lugs, each of said wire lugs having a barrel end and an opposing tang end, each of said tang ends of said wire lugs defining a pair of stud holes and having a desired length and each of said barrel ends having a desired width;

two elongated shafts, each of said shafts having a cross section and a desired length, wherein each of the cross sections has a shape and size smaller than the shapes and sizes of the pair of stud holes, so that the shafts are capable of passing through the pair of stud holes within the tang ends of each of the wire lugs so that the wire lugs may be mounted onto the shafts with the shafts substantially perpendicular to the tang ends of the wire lugs;

one or more conductive spacers, each of said one or more spacers having a desired thickness and a desired length and defining a pair of spacer holes, wherein the shapes and sizes of the spacer holes are larger than the shapes and sizes of the cross sections of the shafts, so that the shafts are capable of passing through the spacer holes such that the one or more spacers may be mounted onto the shafts with the shafts substantially perpendicular to the one or more spacers and the desired thickness of the one or more spacers oriented along the length of the shafts;

at least one locking mechanism having a locking surface, the locking mechanism adapted to engage the shafts at a desired location and to present the locking surface with an orientation substantially perpendicular to the shafts;

a container holding said lugs, said shafts, said one or more spacers, and said at least one locking mechanism; and wherein the plurality of wire lugs and the one or more spacers are capable of being mounted onto the shafts in sandwich fashion, with the shafts substantially perpendicular to the tang ends of the wire lugs and substantially perpendicular to the one or more spacers and the at least one locking mechanism may be engaged with the shafts such that the locking surface secures the wire lugs and one or more spacers at a desired location and in electrical contact.

* * * * *